United States Patent [19]

Lowe

[11] Patent Number: 4,564,828

[45] Date of Patent: Jan. 14, 1986

[54] ELECTROMAGNETIC RELAY

[75] Inventor: Ronnie D. Lowe, Anaheim, Calif.

[73] Assignee: American Zettler, Inc., Irvine, Calif.

[21] Appl. No.: 609,613

[22] Filed: May 14, 1984

[51] Int. Cl.[4] ..... H01H 67/02

[52] U.S. Cl. ..... 335/128; 335/274; 335/276

[58] Field of Search ..... 335/78, 79, 83, 128, 335/129, 229, 230, 276, 274

[56] References Cited

U.S. PATENT DOCUMENTS

| | | | |
|---|---|---|---|
| 3,321,722 | 5/1967 | Cohen | 335/276 |
| 4,323,945 | 4/1982 | Sauer | 335/78 |
| 4,340,876 | 7/1982 | Dammert et al. | 335/276 |

*Primary Examiner*—George Harris

*Attorney, Agent, or Firm*—Harvey C. Nienow

[57] ABSTRACT

An electromagnetic relay wherein a force-transmitting member or actuator is carried by the armature to engage the contactor, which carries a moveable contact, such as to provide several different mechanical advantages in moving the moveable contact into firm engagement with a stationary contact. The actuator is provided with an inclined surface such that when the electromagnetic force on the armature is minimum, the actuator engages the contactor in a particular location to provide a mechanical advantage which requires minimum force in moving the moveable contact, and thereafter when the armature is within its strong magnetic force range, the inclined surface causes such actuator to engage the contactor in a different location to thereby provide maximum travel in urging the moveable contact into engagement with the stationary contact.

12 Claims, 9 Drawing Figures

ELECTROMAGNETIC RELAY

The present invention pertains to electromagnetic relays, but more particularly to means for transmitting the force from a moveable armature therein to a moveable contact wherein several different mechanical advantages are used alternatively in moving a moveable contact into engagement with a stationary contact.

BACKGROUND OF THE INVENTION

Electromagnetic relays have been used for a considerable number of years to enable the presence or absence of electrical energy to alternatively close and open a given electrical circuit. Typically, such relays comprise an electromagnetic motor which, when energized, attracts an armature from its retracted position to an attracted position to thereby move a pair of contacts either into or out of engagement. Usually, electromagnetic relays are employed between several electrical circuits such that when an electrical signal appears in a first circuit, the relay therein responds to complete or to open a second electrical circuit.

It has been realized for a considerable period of time that the electromagnetic strength applied to an armature varies considerably throughout its travel from its retracted position to its attracted position in engagement with a core or pole member which is part of the electromagnetic motor. That is, when the armature is retracted and thus is a maximum distance from the core, the magnetic permeability of the electromagnetic circuit is minimum due to the maximum air gap between the armature and core member. Thereafter, as the armature approaches the core member, the total permeability of the magnetic circuit increases due to diminution of the air gap, thus causing the electromagnetic force applied to the armature to increase accordingly.

For maximum efficiency in effecting movement of a moveable contact relative to a stationary contact, it is desirable to transmit a corresponding amount of force to the moveable contact, namely, a force which changes as the electromagnetic force on the armature changes. Ideally, in fact, it is desirable to have the force on the moveable contact increase at an even faster rate than the force developed between the armature and core member as the armature is attracted to its position of engagement with the core or pole member.

OBJECTS OF THE INVENTION

In view of the foregoing, it is an object of the present invention to provide an electromagnetic relay wherein a force-transmitting member is employed to provide several different mechanical advantages in transmitting the movement of an electromagnetic armature to a moveable contact.

Another object of the present invention is to provide an electromagnetic relay as characterized above wherein initially, as the armature moves from fully retracted position, minimum force is available to the moveable contact, and thereafter, at a predetermined point in the travel of the armature, greater force is available to the moveable contact.

Another object of the present invention is to provide an electromagnetic relay as characterized above which employs a cantilevered contactor which carries the moveable contact and wherein the contactor or force-tranmitting member is caused to engage the contactor at several different locations throughout the travel of the armature in response to energization of the electromagnetic motor.

A further object of the present invention is to provide an electromagnetic relay as characterized above wherein the cantilevered contactor is suitably anchored at one end and the actuator or force-transmitting member is so constructed as to engage the contactor at points therealong which are different distances from the anchored end thereof.

A still further object of the present invention is to provide an electromagnetic relay as characterized above wherein a pivotal armature is employed and the force-transmitting member or actuator is fixed thereto, the latter moving along a circular path as the armature moves under the influence of the electromagnetic motor to thereby change its point of engagement or contact with the contactor.

An even still further object of the present invention is to provide an electromagnetic relay as characterized above wherein the contactor is biased toward an initial position, and the force-transmitting member generates different forces on such contactor against the biasing force of the latter.

Another even still further object of the present invention is to provide an electromagnetic relay as characterized above which provides means for continuously varying the mechanical advantage in transmitting the armature movement to a moveable electrical contact, throughout the entire movement of the armature under the influence of the electromagnetic motor.

Another even still further object of the present invention is to provide an electromagnetic relay as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

Like reference characters indicate corresponding parts throughout the several views of the drawings.

DESCRIPTION OF THE PREFERRED EMBODIMENT

Figure 1:
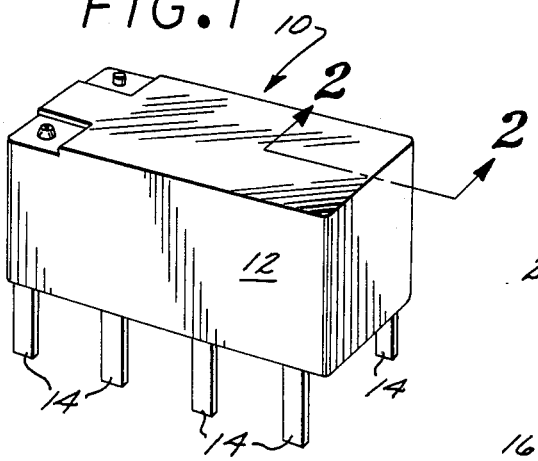
FIG. 1 is a perspective view of an electromagnetic relay in accordance with the present invention.

Referring to FIG. 1 of the drawings, there is shown therein a relay 10 constructed in accordance with the present invention, and comprising a housing 12 and a plurality of terminal pins or blades 14 which extend from one end of the housing for insertion within an appropriate terminal member or socket as are found on printed circuit boards and the like.

Figure 2:
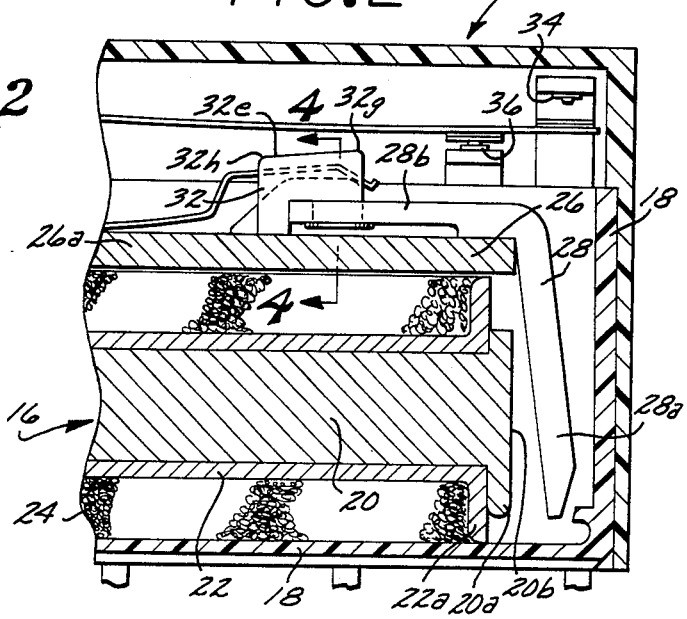
FIG. 2 is a fragmentary sectional view taken substantially along line 2—2 of FIG. 1 of the drawings.
Figure 3:
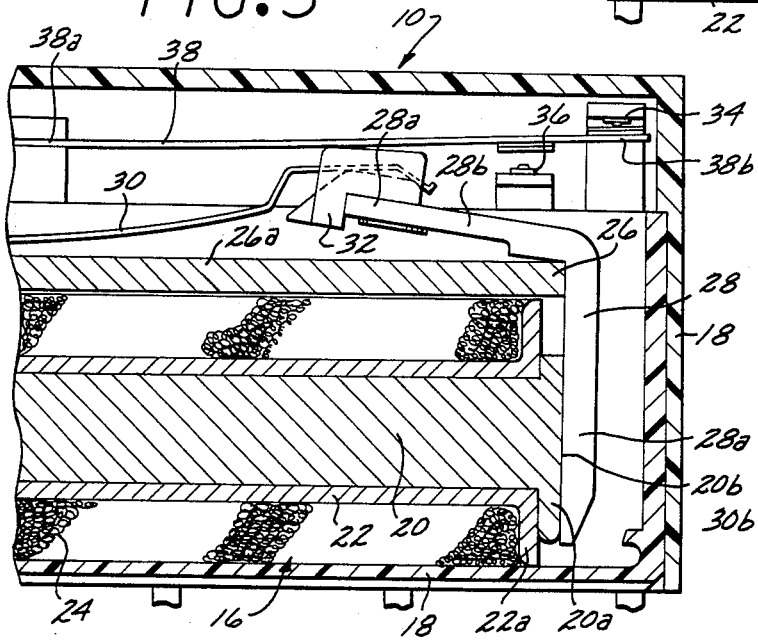
FIG. 3 is a similar fragmentary sectional view showing the armature in attracted position.

Referring most particularly to FIGS. 2 and 3 of the drawings, the relay 10 comprises an electromagnetic motor 16 which is positioned within an appropriate insulating casing 18, the latter of which may be formed of any appropriate plastic material such as nylon or the like. Mounted within casing 18 and forming a part of electromagnetic motor 16 is a core member 20 formed of magnetically permeable material and having an electromagnetic pole 20*a* affording a pole face 20*b*.

Such core member 20 is positioned within a spool or bobbin 22 of any appropriate plastic material such as nylon or the like. Bobbin 22 is provided with a pair of opposite end flanges, one of which is shown at 22*a*. A winding 24 composed of a plurality of juxtaposed convolutions of electrical wire is provided on the plastic bobbin 22 between the oppositely disposed annular flanges.

For completing the electromagnetic circuit with core 20, an L-shaped frame 26 is provided so as to have a frame member 26*a* disposed substantially parallel with the axis or center line of core 20. Also forming part of frame 26 is frame member 26*b* (FIG. 6) which is part of the magnetic circuit associated with the electromagnetic motor 16.

Frame 26 is formed with side tabs 26*c*, each of which is formed with a rectangular through opening 26*d* for mating engagement with suitably formed extensions (not shown) on housing 18 to tie together the entire structure. Frame 26 is further formed, at one end of frame member 26*a*, with a pair of oppositely located tabs 26*e* which provide an intermediate U-shaped cradle 26*f* for receiving an L-shaped armature 28, as will hereinafter become apparent. Also formed along the opposite edges of frame member 26*a* are locking tabs 26*g* for receiving and retaining a return spring 30.

Armature 28 is generally L-shaped having an armature portion 28*a* for engagement with the pole face 20*b* of core member 20, and an armature portion 28*b* for actuating the electrical contacts, as will be hereinafter described.

Figure 6:
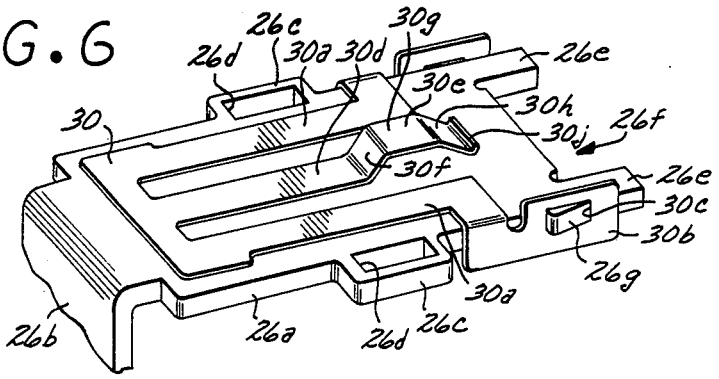
FIG. 6 is a fragmentary perspective view of the armature and biasing means thereof.
Figure 7:
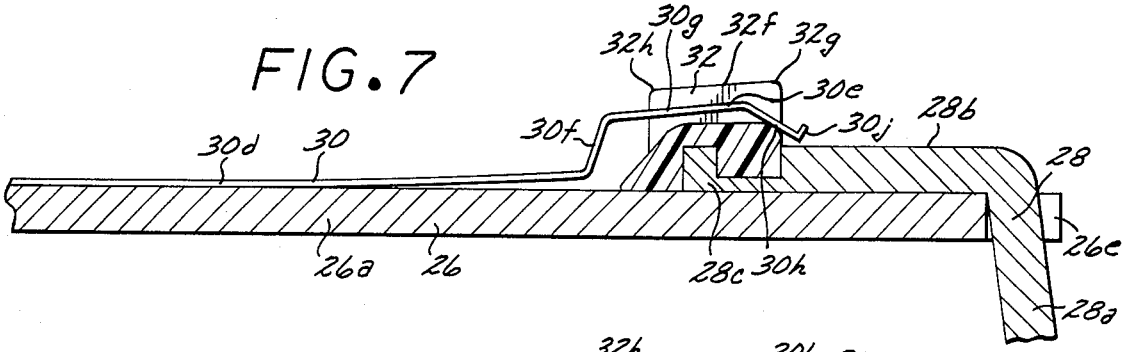
FIG. 7 is a fragmentary sectional view showing the armature in retracted position.
Figure 8:
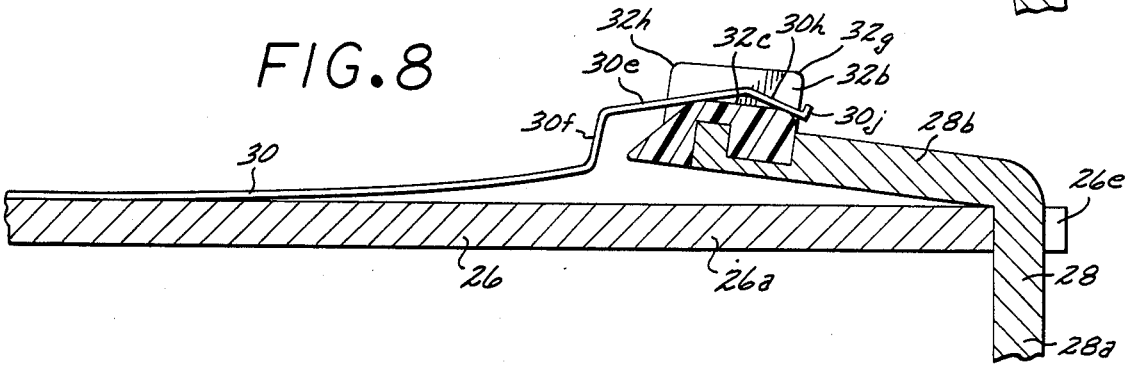
FIG. 8 is a fragmentary sectional view similar to FIG. 7, but showing the armature in attracted position.

As shown most particularly in FIG. 6 of the drawings, return spring 30 is formed by stamping or the like from spring steel, and has oppositely-shaped side mounting legs 30*a*, each of which is formed with an offset 30*b* having a through mounting hole 30*c*.

As shown most clearly in FIG. 6, the offsets 30*b* are slid over the locking tabs 26*g*, each of the latter of which is formed with an inclined surface enabling the locking tabs to ride up on such tabs to properly locate and lock the return spring 30 in proper position on frame member 26*a* of frame 26.

Spring 30 is further formed with a centrally located extension 30*d* having a generally arcuate portion 30*e* formed by angularly offset sections 30*f*, 30*g* and 30*h*. The marginal edge of extension 30*d* is provided with a reversely bent lip 30*j*.

Figure 4:
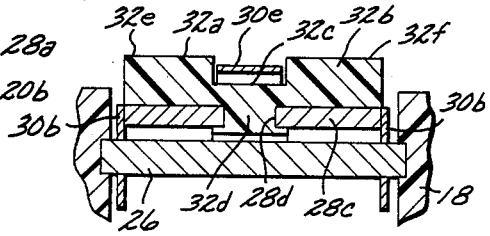
FIG. 4 is a fragmentary sectional view taken substantially along line 4—4 of FIG. 2 of the drawings.
Figure 5:
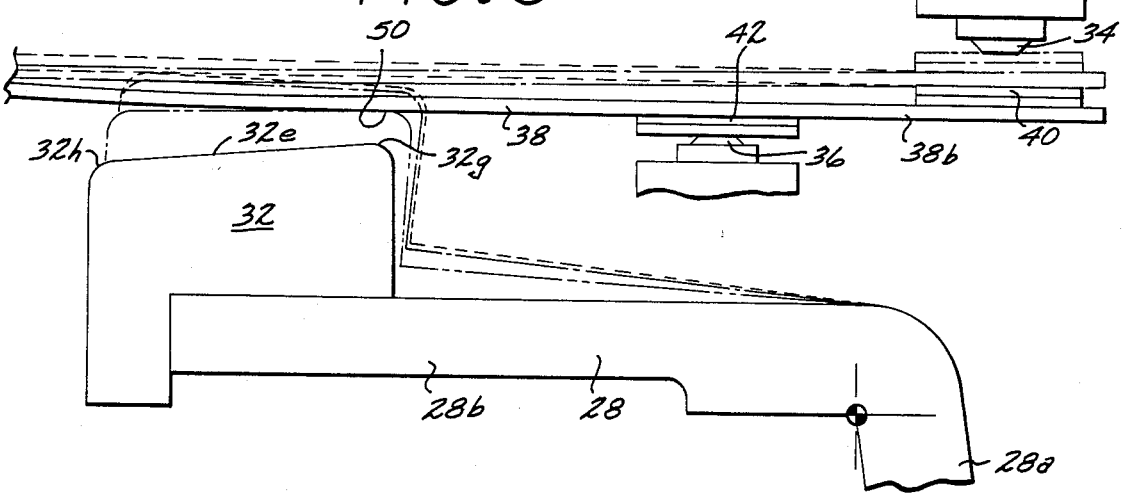
FIG. 5 is a schematic showing of the changing relationship between the force-transmitting member and the contactor.

Fixed to the end 28*c* of armature portion 28*b* is a force-transmitting member or actuator 32. As shown, actuator 32, which is formed of any suitable plastic such as nylon or the like, comprises substantially identically shaped actuator sections 32*a* and 32*b* separated by an intermediate section 32*c*. An extension 32*d* extends through a suitable opening 28*d* in the end 28*c* of armature 28 for firmly securing actuator 32 to the armature, as shown in FIG. 4.

As shown in FIGS. 2, 3, 5, 7 and 8, each of the actuator sections 32*a* and 32*b* is provided with an inclined surface 32*e* and 32*f*, respectively, to provide a plurality of contact points, as will hereinafter be explained in greater detail. As shown most clearly in FIG. 4 of the drawings, the armature assembly is positioned into the cradle 26*f* of frame member 26*a* with the extension 30*d* spaced from frame member 26*a* such that the arcuate portion of extension 30*d* rests on the intermediate portion 32*c* of actuator 32, the sections 32*a* and 32*b* of actuator 32 being on top of mounting legs 30*a*.

Positioned within housing 12 of electromagnetic relay 10 is a pair of normally open stationary contacts 34 and a pair of normally closed contacts 36, only one of which is shown in the drawings. Suitable support means is provided for the four stationary contacts. Typically, such contacts are formed of copper alloy and each is provided with a contact tip formed of gold plated silver alloy or with any other appropriate electrically conductive material.

Positioned intermediate each pair of normally open stationary contacts 34 and a normally closed stationary contact 36 is a contactor 38 formed of flexible material and having one end 38*a* anchored with respect to the housing 12. Such mounting of the contactors 38 causes each of them to be cantilevered so that its inherent bending forces, as will hereinafter appear in greater detail, effectively bias the contactors against the force of the armature 28. The other end portions 38*b* of each contactor 38 carries moveable contacts 40 and 42 for engagement, respectively, with the corresponding stationary contacts 34 and 36. The biasing effects of contactors 38 is in the direction to cause each contact 42 to engage its corresponding stationary contact 36 and moveable contact 40 to be out of engagement with stationary contact 34. This arrangement is shown in FIG. 2 of the drawings wherein the armature 28 is in its fully retracted position.

When it is desired to open the circuits which include stationary contacts 36, and to close the circuits having stationary contacts 34, it is merely necessary to energize electromagnetic motor 16 by applying suitable electrical energy through the appropriate terminal pins or blades 14 to winding 24. This causes electromagnetic flux to be generated in core member 20, frame 26 and armature 28, including the air gap between armature portion 28*a* and pole face 20*b*, as shown in FIG. 2. Such electromagnetic flux, of course, causes armature portion 28*a* to be attracted to pole face 20*b* to minimize or decrease the air gap in the electromagnetic circuit. However, due to the fact that such air gap is of maximum width or size with armature 28 in its fully retracted position, the total magnetic permeability in the magnetic circuit is minimum so that only minimum force is exerted on armature 28. At this time, actuator sections 32*a* and 32*b* are a predetermined distance from engagement with contactors 38 so that only a minimum force is required to attract armature portion 28*a* toward the pole face 20*b*.

As the armature is drawn toward engagement of armature portion 28*a* with pole face 20*b*, the magnetic strength or force on the armature increases due to narrowing of the aforementioned air gap. Ultimately, as shown most particularly in FIG. 5 of the drawings, actuator sections 32*a* and 32*b* engage the respective contactor 38 at location 50, respectively, by virtue of abutting engagement of the points 32*g* of actuator sections 32*a* and 32*b* with the locations 50 on the respective contactors 38.

Each location 50 on the respective contactors 38 is a predetermined distance from the anchor or mounting of the respective contactor. Immediately after such initial contact, further movement of the armature 28 under the influence of the continuing magnetic force, requires only a minimum force since maximum leverage exists between actuator 32 and the contactors. This is desirable at this time since the larger air gap between the armature portion 28*a* and the pole face 20*b* renders the magnetic flux less effective in producing a strong attractive force on the armature.

As the armature portion 28*a* approaches the pole face 20*b* of core member 20, the actuator 32 is caused to change its point of contact with the contactors 38, thus causing point 32*h* of actuator sections 32*a* and 32*b* to engage the respective contactors at location 52. This shortens the moment arm or distance between the cantilevered mounting means and the force-transmitting actuator sections 32*a* and 32*b* so that greater resistance to movement is transmitted from the contactors to the armature. At this time, however, armature portion 28*a* is closer to pole face 20*b*, thus enabling the electromagnetic circuit to generate greater forces on the armature due to the increased permeability of the total magnetic circuit.

After the moveable contacts 40 engage the corresponding stationary contacts 34, the increased strength of the electromagnetic motor 16 continues to be transmitted to the moveable contacts 40, thus causing the maximum force to be applied in making strong contact between the moveable and stationary contacts. A good firm electrical connection is thus established and maintained between moveable contacts 40 and stationary contacts 34.

When electromagnetic motor 16 is deenergized, intermediate extension 30*d* of return spring 30 causes armature 28 to pivot counterclockwise, as shown in the drawings, to its retracted position, as shown in FIG. 2. That causes the moveable contacts 40 to be disengaged from the stationary contacts 34 and moveable contacts 42 to be moved into engagement with stationary contacts 36 under the inherent biasing influence of the contactors 38.

Figure 9:
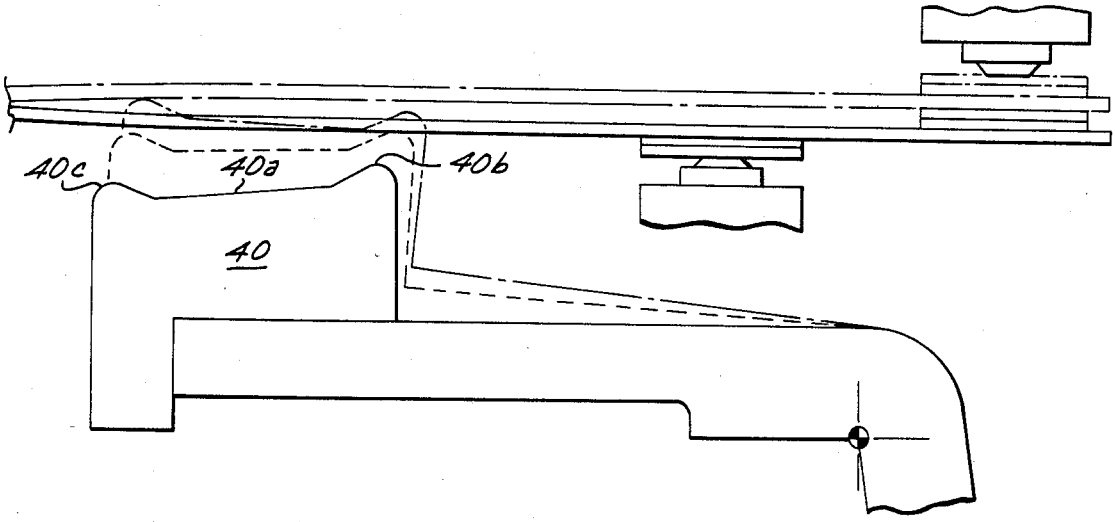
FIG. 9 is a schematic showing of a second embodiment of the present invention.

The embodiment of the present invention shown in FIG. 9 comprises an actuator 40 in place of the actuator 32 of the first embodiment. The armature 28 on which the actuator 40 is mounted is identical with the armature 28 of the first embodiment, as are all other components, other than the actuator.

Actuator 40 is formed with a recessed intermediate portion, as at 40*a*, with respect to both of the actuator portions of the second embodiment. Thus, as the armature of which actuator 40 is mounted is attracted, the actuator first contacts the contactors at locations 40*b*, and thereafter, upon further movement of such armature, locations 40*c* come into engagement with the respective contactors.

It is thus seen that the present invention provides an electromagnetic relay which is capable of generating optimum forces and movements for performing the necessary work of opening and closing electrical circuits in the most efficient and desirable manner.

Although I have shown and described certain specific embodiments of my invention, I am well aware that many modifications thereof are possible. The invention, therefore, is not to be restricted except insofar as in necessitated by the prior art and by the spirit of the appended claims.

I claim:

1. In an electromagnetic relay having an electromagnetic motor, an armature moveable in response to energization and deenergization of said motor, and contact means including a stationary contact and a moveable contact carried by a moveable contact arm, the combination of a force-transmitting member fixed relative to said armature of movement therewith relative to said contact arm, said force-transmitting member comprising means to provide at least two sequentially operable mechanical advantages in urging said moveable contact into engagement with said stationary contact.

2. In an electromagnetic relay, the combination according to claim 1 wherein the means on said force-transmitting member is operatively interposed between said motor and said moveable contact to provide the said mechanical advantages in predetermined relation to the variations in strength between said armature and said motor.

3. In an electromagnetic relay, the combination according to claim 2 wherein said mechanical advantages differ with respect to the amount of movement of said moveable contact in response to a given amount of movement of said armature under the influence of said motor.

4. In an electromagnetic relay, the combination according to claim 3 wherein the means on said force-transmitting member causes greater movement of said moveable contact when said given amount of movement of said armature occurs while said armature is in close proximity to said motor than when said given amount of armature movement occurs when said armature is farther from said motor.

5. In an electromagnetic relay, the combination according to claim 4 wherein said contact arm is elongated and has said moveable contact mounted relative to one end thereof, the other end thereof being mounted substantially stationary, the means on said force-transmitting member being operatively interposed between said armature and said contact arm to contact said contact arm between its said ends to move said moveable contact relative to said stationary contact.

6. In an electromagnetic relay, the combination according to claim 5 wherein the means on said force-transmitting member is operatively interposed between said armature and said contact arm and is formed to alter the effective length of the moment arm in transmitting the force from said armature to said contact arm.

7. In an electromagnetic relay, the combination according to claim 6 wherein the means on said force-transmitting member is responsive to actuation of the armature by said motor to decrease the moment arm of the armature in applying the force from said armature to said contact arm when said armature is in close proximity to said motor.

8. In an electromagnetic relay, the combination according to claim 7 wherein pivot-mounting means is provided for said armature and the means on said force-transmitting means alters its contact point on said contact arm as said armature is pivoted about its pivot-mounting means under the influence of said motor.

9. In an electromagnetic relay, the combination according to claim 8 wherein the means on said force-transmitting member is formed with at least two spaced contact points which alternately contact said contact arm during movement of said armature by said motor.

10. In an electromagnetic relay, the combination according to claim 9 wherein said contact arm is biased to a predetermined position and said armature is operable to cause the means on said force-transmitting member to contact said contact arm to move said moveable contact into engagement with said stationary contact against said bias.

11. In an electromagnetic relay, the combination according to claim 10 wherein said contact arm is anchored at said other end thereof so that said bias results from bending of said contact arm.

12. In an electromagnetic relay, the combination according to claim 11 wherein said force-transmitting member is operatively associated with said armature for movement by said armature, said movement causing the means on said force-transmitting member to change its contact with said contact arm from one to another of said contact points to thereby alter the mechanical advantage in transmitting armature force to said contact arm.

* * * * *